US008845355B2

(12) United States Patent
Litowitz et al.

(10) Patent No.: US 8,845,355 B2
(45) Date of Patent: Sep. 30, 2014

(54) BLOCKOUT DEVICE FOR USB PORT

(71) Applicant: Panduit Corp., Tinley Park, IL (US)

(72) Inventors: Daniel T. Litowitz, Hudson, OH (US); Jason O. Hackett, Canton, GA (US); Marc R. Obenshain, Cumming, GA (US)

(73) Assignee: Panduit Corp., Tinley Park, IL (US)

( * ) Notice: Subject to any disclaimer, the term of this patent is extended or adjusted under 35 U.S.C. 154(b) by 45 days.

(21) Appl. No.: 13/653,530

(22) Filed: Oct. 17, 2012

(65) Prior Publication Data

US 2013/0102167 A1 Apr. 25, 2013

Related U.S. Application Data

(60) Provisional application No. 61/549,335, filed on Oct. 20, 2011, provisional application No. 61/558,858, filed on Nov. 11, 2011.

(51) Int. Cl.
*H01R 13/625* (2006.01)
*H01R 13/52* (2006.01)
*H01R 13/443* (2006.01)

(52) U.S. Cl.
CPC ..... *H01R 13/5213* (2013.01); *H01R 13/443* (2013.01)
USPC ..... 439/357

(58) Field of Classification Search
USPC ..... 439/357, 135, 133, 567, 367, 373
See application file for complete search history.

(56) References Cited

U.S. PATENT DOCUMENTS

| | | | | |
|---|---|---|---|---|
| 3,317,989 | A | 5/1967 | Cull | |
| 3,443,297 | A | 5/1969 | Lusby, Jr. | |
| 3,570,096 | A | 3/1971 | Sosinski | |
| 4,155,159 | A | 5/1979 | Hogan et al. | |
| 4,781,408 | A | 11/1988 | Hernandez | |
| 6,139,350 | A | 10/2000 | Mathesius | |
| 6,991,479 | B2 | 1/2006 | Miao | |
| 7,014,490 | B1 | 3/2006 | Morikawa et al. | |
| 7,094,099 | B2 * | 8/2006 | Daggett et al. | 439/567 |
| 7,128,586 | B2 | 10/2006 | Kung | |
| 7,285,004 | B1 | 10/2007 | Fukuda et al. | |
| 7,428,834 | B1 | 9/2008 | Lee | |
| 7,462,045 | B1 * | 12/2008 | Lee | 439/133 |
| 7,465,181 | B1 | 12/2008 | Bridges et al. | |
| 7,479,021 | B2 | 1/2009 | Huang | |
| 7,484,991 | B1 | 2/2009 | Kelaher et al. | |
| 7,559,788 | B2 * | 7/2009 | Legg | 439/373 |
| 7,578,691 | B2 | 8/2009 | Weksler et al. | |
| 7,611,371 | B2 * | 11/2009 | Guo | 439/367 |

(Continued)

FOREIGN PATENT DOCUMENTS

CN 201797148 U 4/2011

*Primary Examiner* — Alexander Gilman
(74) *Attorney, Agent, or Firm* — Christopher S. Clancy; Aimee E. McVady

(57) ABSTRACT

A blockout device for a USB port is disclosed. The USB port has an inner channel and metal clips positioned within the channel. The blockout device has a front that covers the inner channel of the USB port. The blockout device also includes a top, a bottom and sides extending from the front. The bottom extends parallel to the top with an open area therebetween. When the blockout device is installed in the USB port, the sides engage the metal clips positioned in the channel of the USB port to secure the blockout device to the USB port.

9 Claims, 14 Drawing Sheets

(56) References Cited

U.S. PATENT DOCUMENTS

| | | | | |
|---|---|---|---|---|
| 7,635,272 | B2 | 12/2009 | Poppe | |
| 7,677,065 | B1 | 3/2010 | Miao | |
| 7,682,181 | B1 * | 3/2010 | Jones et al. | 439/352 |
| 7,722,378 | B2 | 5/2010 | Morrison et al. | |
| 7,862,365 | B2 | 1/2011 | Morrison et al. | |
| 7,878,865 | B2 | 2/2011 | Desrosiers et al. | |
| 8,033,853 | B2 | 10/2011 | Chang | |
| 8,112,879 | B2 | 2/2012 | Morrison et al. | |
| 8,113,856 | B2 | 2/2012 | Morrison et al. | |
| 8,202,110 | B2 | 6/2012 | Morrison et al. | |
| 8,425,249 | B2 * | 4/2013 | Hackett et al. | 439/357 |
| 2005/0039502 | A1 | 2/2005 | Avganim | |
| 2007/0162655 | A1 | 7/2007 | Huang | |
| 2010/0317215 | A1 | 12/2010 | Chang | |
| 2011/0008981 | A1 | 1/2011 | McSweeney et al. | |

* cited by examiner

BLOCKOUT DEVICE FOR USB PORT

CROSS-REFERENCE TO RELATED APPLICATIONS

This application claims priority to U.S. Provisional Application Ser. No. 61/549,335, filed Oct. 20, 2011, and U.S. Provisional Application Ser. No. 61/558,858, filed Nov. 11, 2011, the subject matter of which is hereby incorporated by reference in its entirety.

FIELD OF THE INVENTION

The present invention relates to a blockout device, and more particularly to a blockout device for a USB port for preventing contamination, damage or misuse of the USB port when not in use.

BACKGROUND OF THE INVENTION

A USB receptacle is a common data port located on electronics devices, e.g. computers, laptops, printers and control devices. With the widespread use of USB ports, it has become a high priority to provide security to the data available via the USB port. Therefore it is important to protect and lock the USB port from contamination, damage or misuse. A USB port lock device is typically inserted in the USB port when the port is not in use to protect the port and to prevent unauthorized access to the port. Prior USB port lock devices engage the openings on the top side of the USB port. However, the prior port lock devices are not compatible with all USB ports since the top side of the USB port doesn't always include openings. Even though prior lock devices cover the USB port, the devices fail to provide a tamper resistant blockout device that securely locks all USB ports.

Thus, it would be desirable to provide an improved tamper resistant blockout device that secures the USB port when not in use.

SUMMARY OF THE INVENTION

The present invention is directed toward a blockout device for a USB port. The USB port has an inner channel and metal clips positioned within the channel. The blockout device includes a front that covers the inner channel of the USB port. The blockout device also includes a top and a bottom extending from the back surface of the front. The bottom extends parallel to the top with an open area therebetween. The blockout device also includes sides that extend from the back surface of the front. When the blockout device is installed in the USB port, the sides engage the metal clips positioned in the channel of the USB port to secure the blockout device to the USB port.

DETAILED DESCRIPTION

Figure 1:
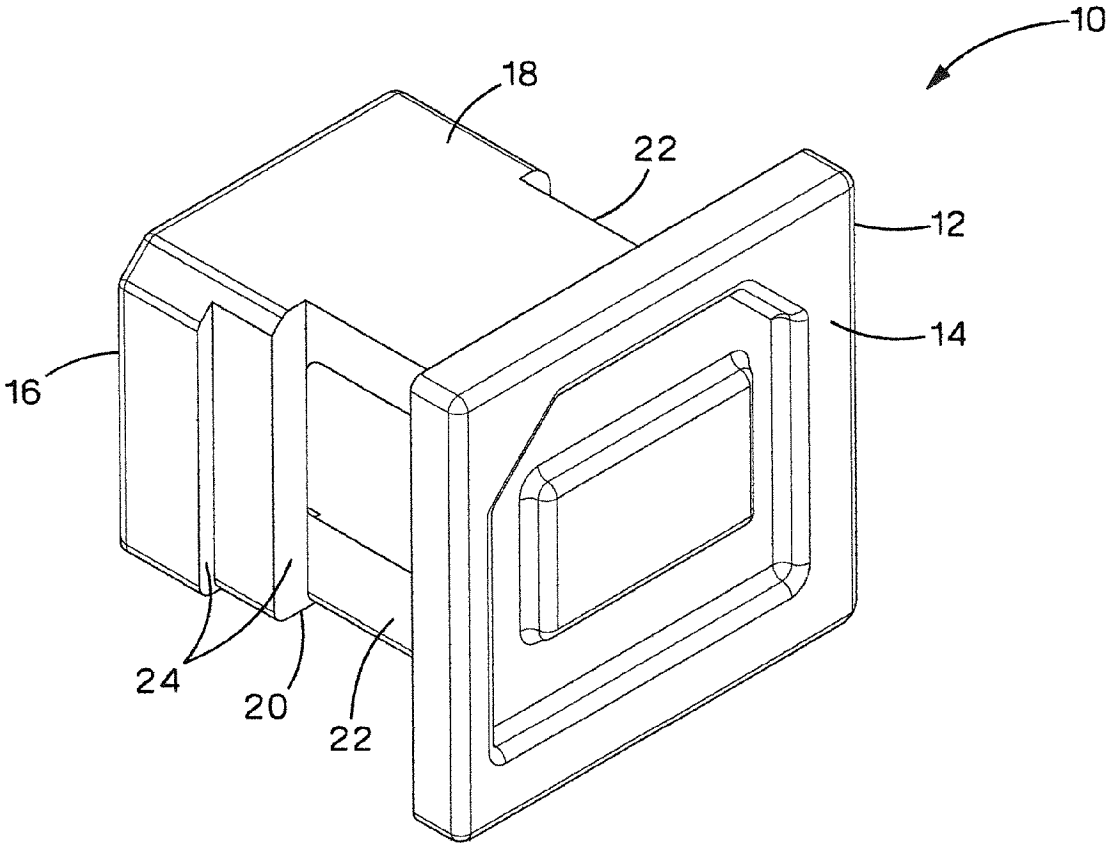
FIG. 1 illustrates a perspective view of the blockout device of the present invention.
Figure 2:
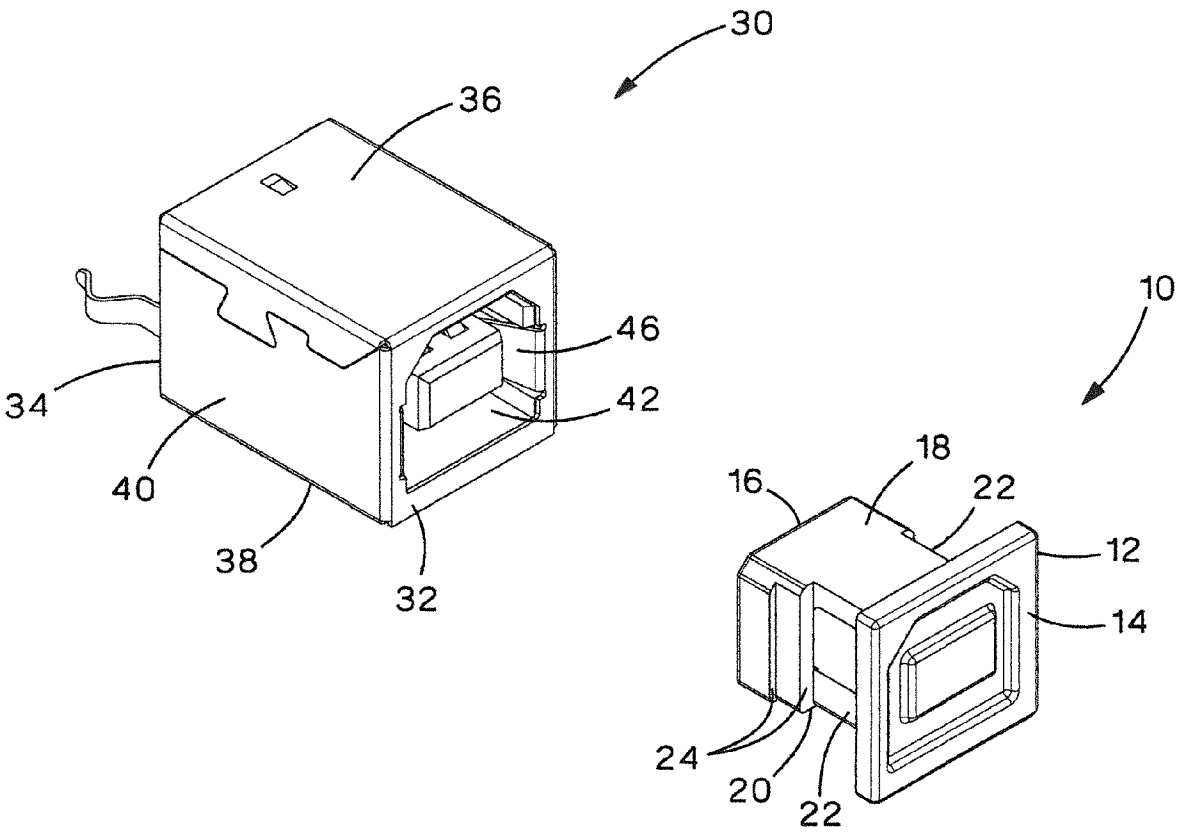
FIG. 2 illustrates a perspective view of the blockout device of FIG. 1 positioned to be installed in a USB port.

FIG. 1 illustrates the blockout device 10 of the present invention. The blockout device 10 is a permanent device designed for USB "B" ports 30. As illustrated in FIG. 2, USB "B" ports are square shaped. The blockout device 10 is used when it is desirable to protect and prevent access to data transfer, power, or storage of the USB "B" port 30.

The blockout device 10 includes a front 12, a back 16, a top 18, a bottom 20 and sides 22. The front 12 of the blockout device 10 includes a cover plate 14 for covering the opening in the USB port 30. The sides 22 of the blockout device 10 include stepped ledges 24 positioned towards the back 16 of the blockout device 10. As described below, the stepped ledges 24 ensure that blockout device 10 remains in the USB port 30.

Figure 3:
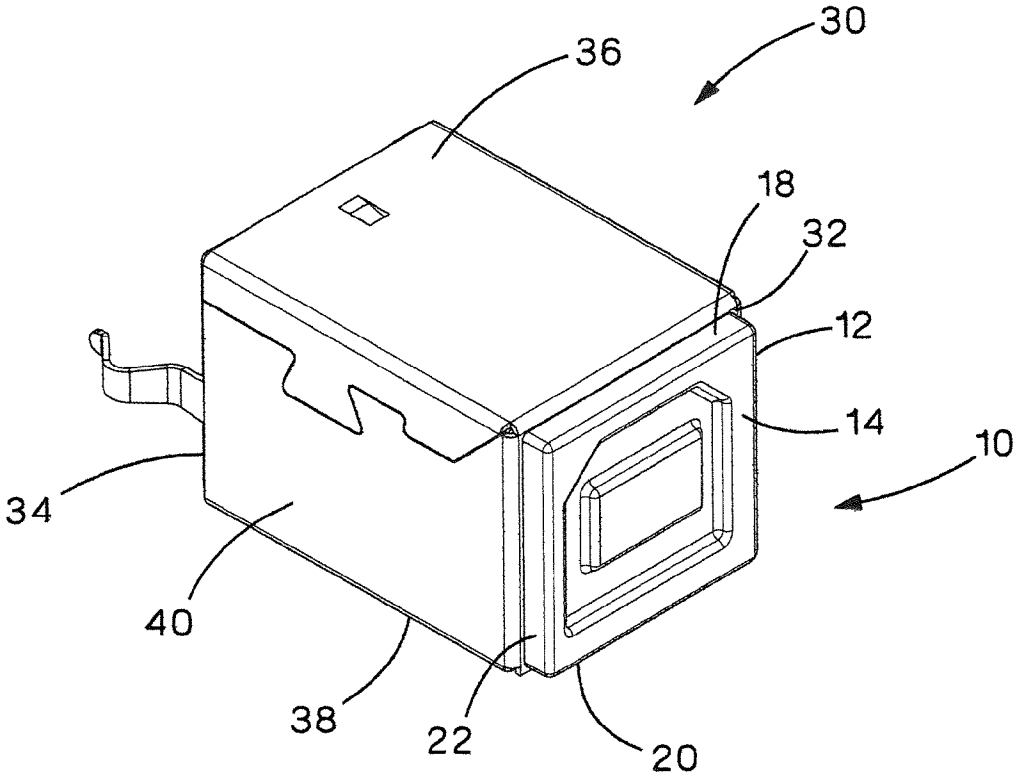
FIG. 3 illustrates a perspective view of the blockout device installed in the USB port of FIG. 2.
Figure 4:
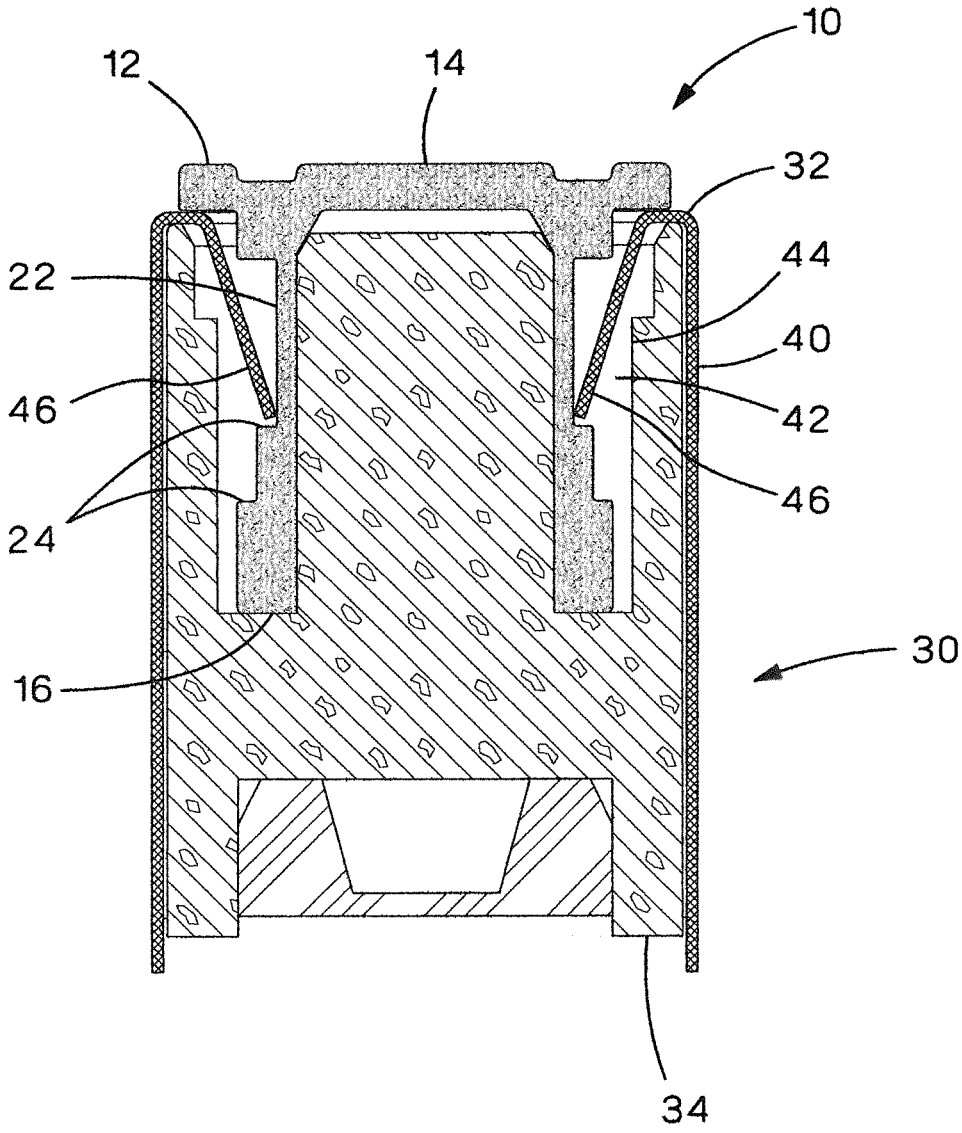
FIG. 4 illustrates a cross sectional view of the blockout device installed in the USB port of FIG. 3.
Figure 5:
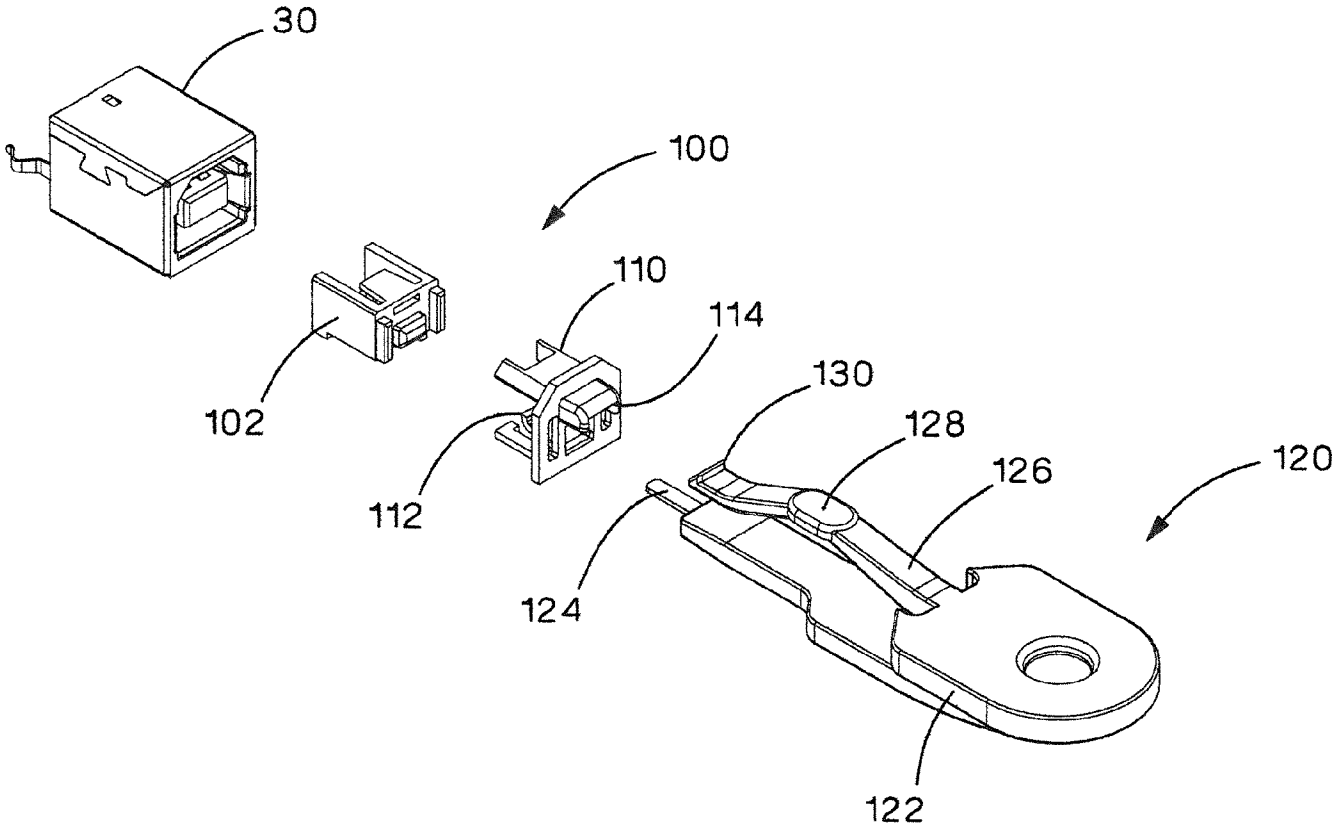
FIG. 5 illustrates an exploded view of an alternative blockout device of the present invention to be installed in the USB port.

As illustrated in FIGS. 2-4, the USB port 30 includes a front 32, a back 34, a top 36, a bottom 38 and sides 40. The USB port 30 also includes a channel 42 defined by the front 32, top 36, bottom 38 and sides 40. Metal USB port clips 46 are positioned within the channel 42. As illustrated in FIGS. 2 and 4, each side of the USB port 30 includes a port clip 46 that extends in the channel 42 from the front 32 towards the back 34 of the USB Port 30. The port clips 46 are rectangular and can be compressed from a first position to a second position when a USB input is inserted in the USB port. The port clips 46 are designed to hold a USB input in the port with friction.

When the blockout device 10 is installed in the USB port 30, the stepped ledges 24 on each side of the blockout device 10 compress the port clips 46 against the inner side wall 44 of the channel 42 until the blockout device 10 is fully inserted. Once the blockout device 10 has been fully inserted, the port clips 46 are no longer compressed. The port clips 46 snap back to their original position (see FIG. 4).

As illustrated in FIG. 4, the stepped ledges 24 on the side of the blockout device 10 are behind the port clips 46. If the blockout device 10 was attempted to be removed, the stepped ledges 24 would encounter the port clips 46 end-on. In this configuration, the port clips 46 would not be able to bend out of the way. As a result, the port clips 46 prevent the blockout device 10 from being removed from the USB port 30.

The stepped ledges 24 of the blockout device 10 are designed to accommodate a plurality of metal port clip sizes housed in the various USB ports, which can vary by manufacturer.

FIGS. 5-10 illustrate the alternative blockout device 100 for the USB "B" port 30. The alternative blockout device 100 is a removable blockout device that is removed from the USB port 30 via a removal tool 120. The removal tool 120 includes a body 122 with a release lever 126. A metal tab 124 extends from the front of the body 122. The release lever 126 includes a raised knob 128 at the center of the release lever 126 and an upwardly facing hook 130 at the free end.

Figure 6:
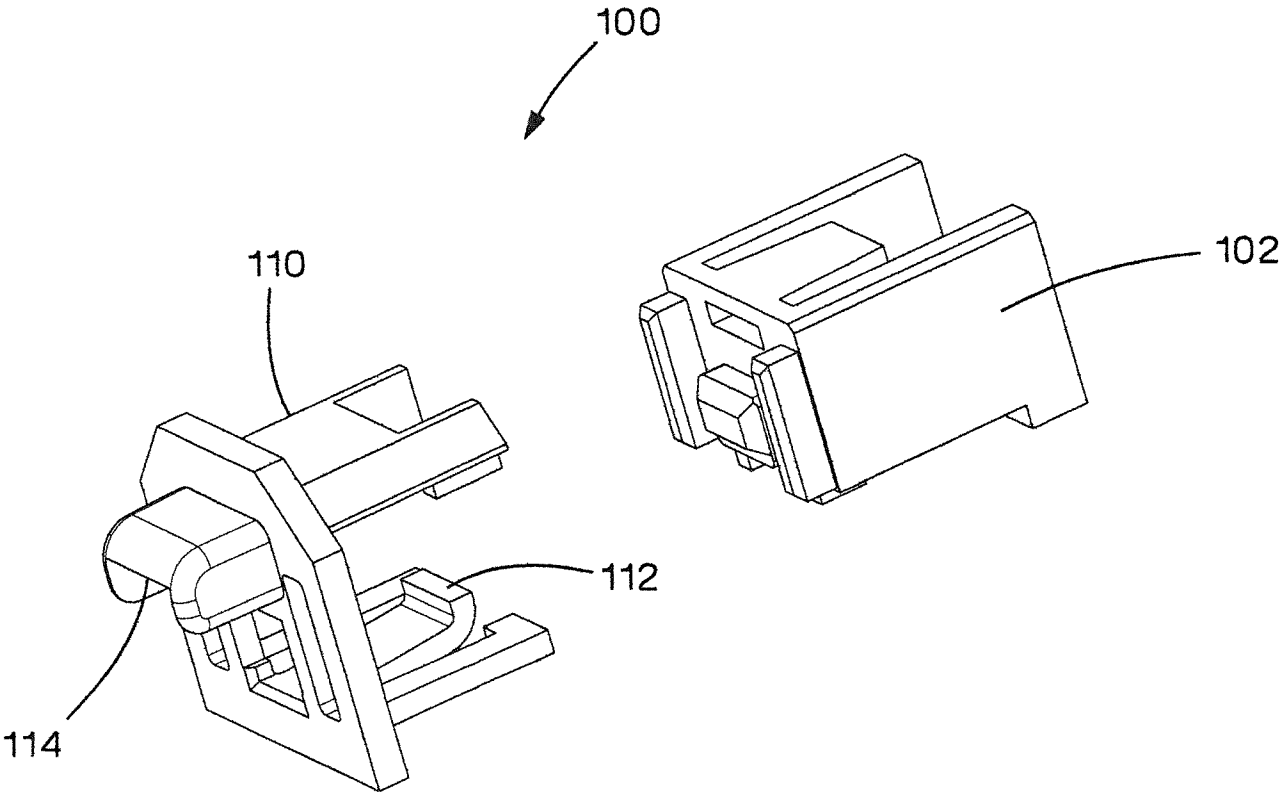
FIG. 6 illustrates a front perspective view of the blockout device of FIG. 5.
Figure 7:
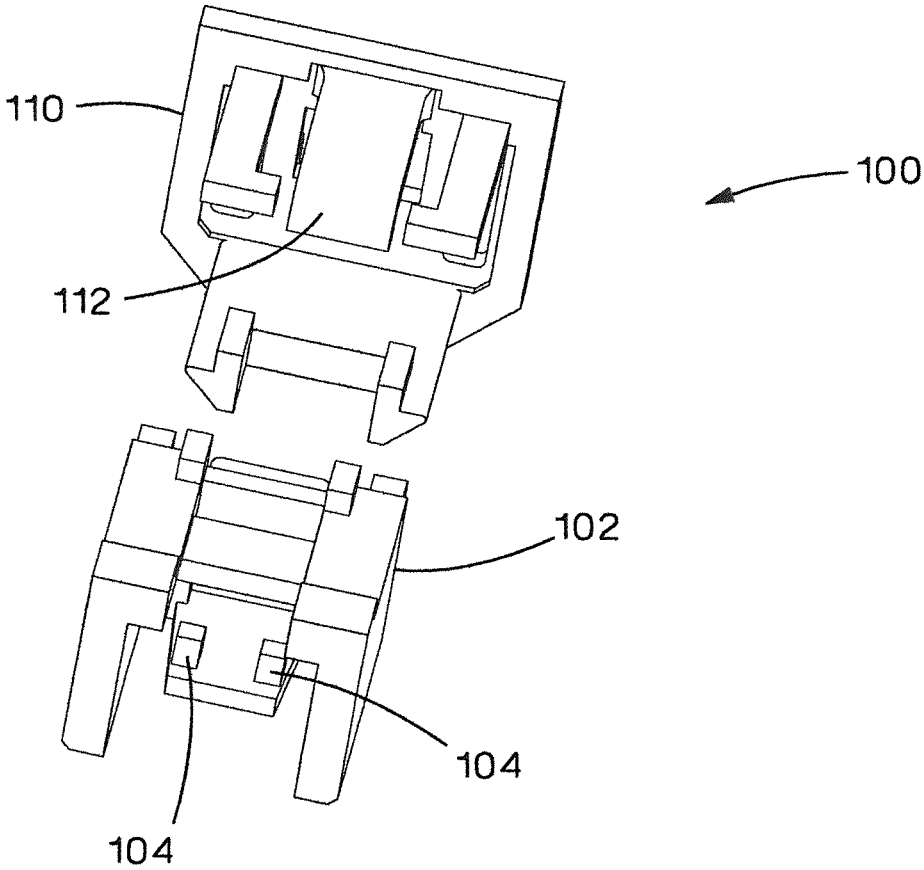
FIG. 7 illustrates a rear perspective view of the blockout device of FIG. 5.

As illustrated in FIGS. 6 and 7, the removable blockout device 100 includes a body 102 and a shell 110. The shell 110 is positioned over the body 102 when the blockout device 100 is installed in the USB port 30. The body 102 includes molded teeth 104 (see FIG. 7) for engaging the USB port 30. The bottom of the shell 110 includes a molded latch 112 that snaps into a pocket 106 (see FIG. 8) in the body 102 to prevent the blockout device 100 from being removed without a tool. The front of the shell 110 also includes a downwardly facing hook 114 for engaging the removal tool 120 when the removal tool 120 is installed in the blockout device 100.

Figure 8:
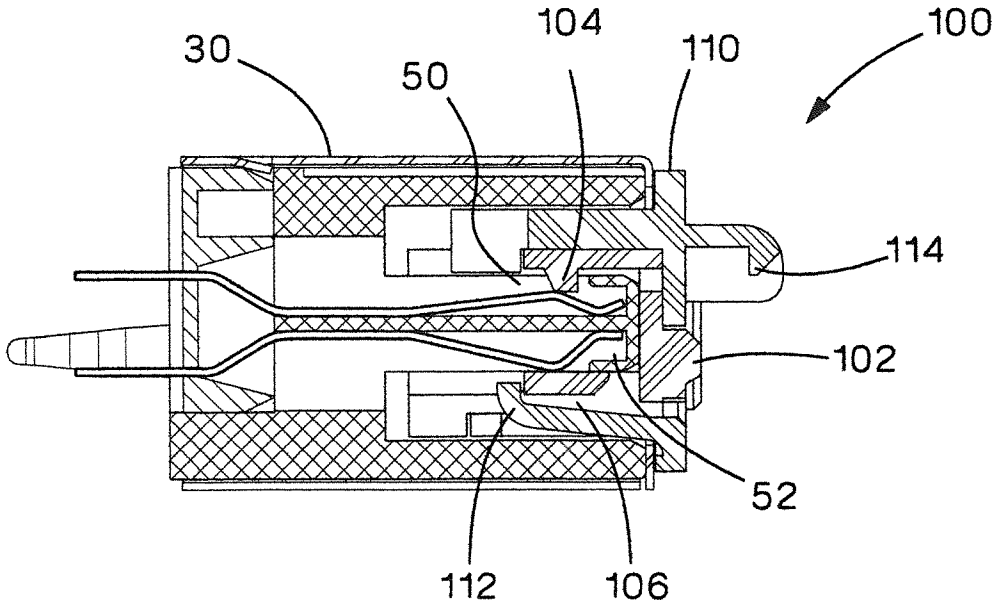
FIG. 8 illustrates a cross sectional view of the blockout device of FIG. 5 installed in the USB port.

The end user inserts the blockout device 100 until it snaps and locks into place in the USB port 30. More specifically, the blockout device 100 is pushed into the USB port 30 until the blockout device 100 engages the back wall of the USB port 30. Once installed, as illustrated in FIG. 8, the molded teeth 104 extending from the body 102 are positioned in the contact slots 50 in the contact plate 52 of the USB port 30. The molded latch 112 of the shell 110 is positioned in a pocket 106 in the bottom of the body 102. The molded latch 112 prevents the body 102 and shell 110 from separating which would enable the molded teeth 104 on the body 102 to be lifted out of the contact slots 50.

Figure 9:
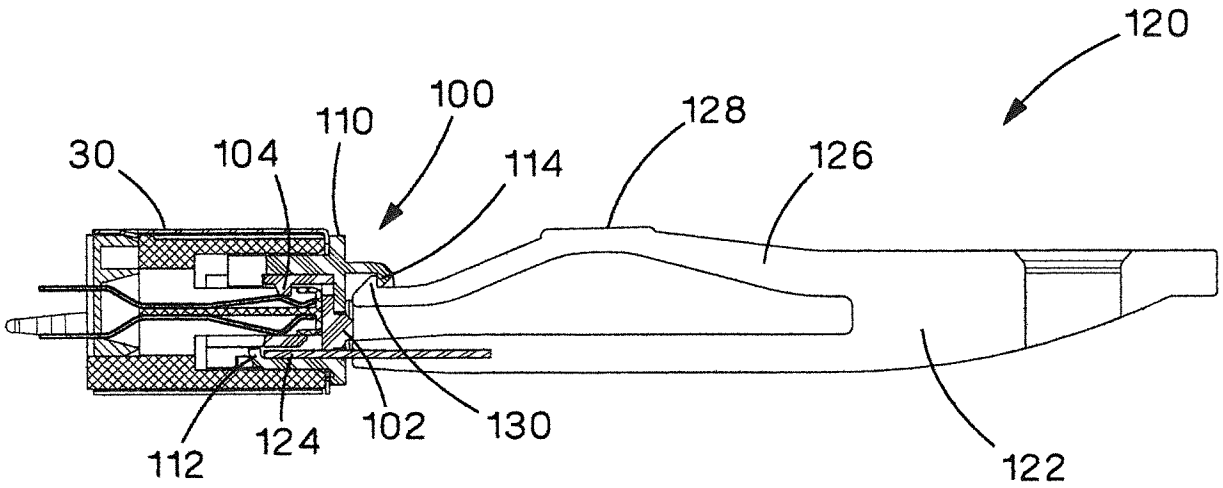
FIG. 9 illustrates a cross sectional view of the removal tool installed in the blockout device of FIG. 8 installed in the USB port.
Figure 10:
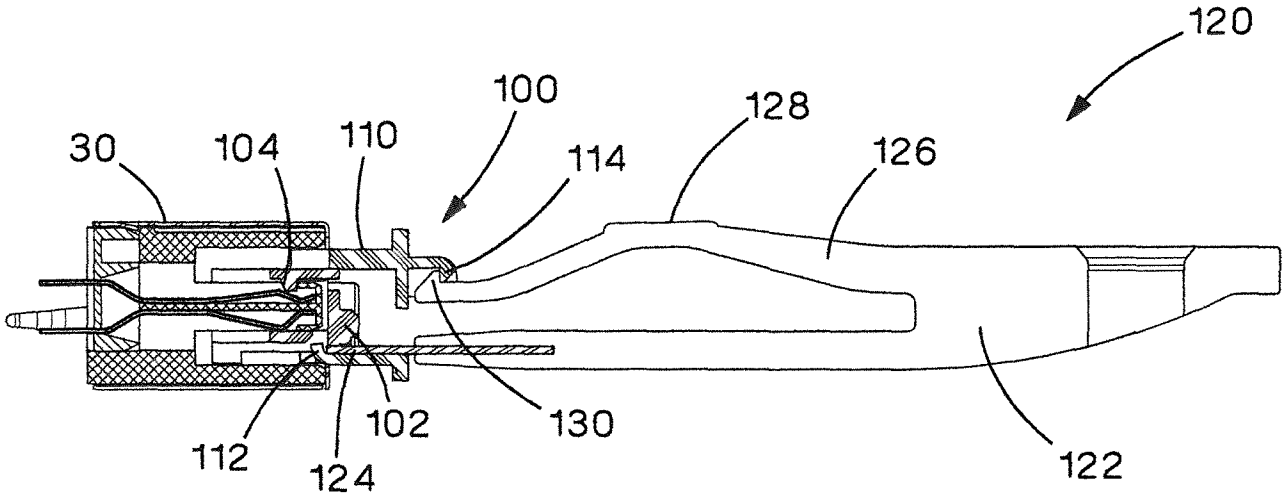
FIG. 10 illustrates a cross sectional view of the removal tool removing the blockout device of FIG. 8.
Figure 11:
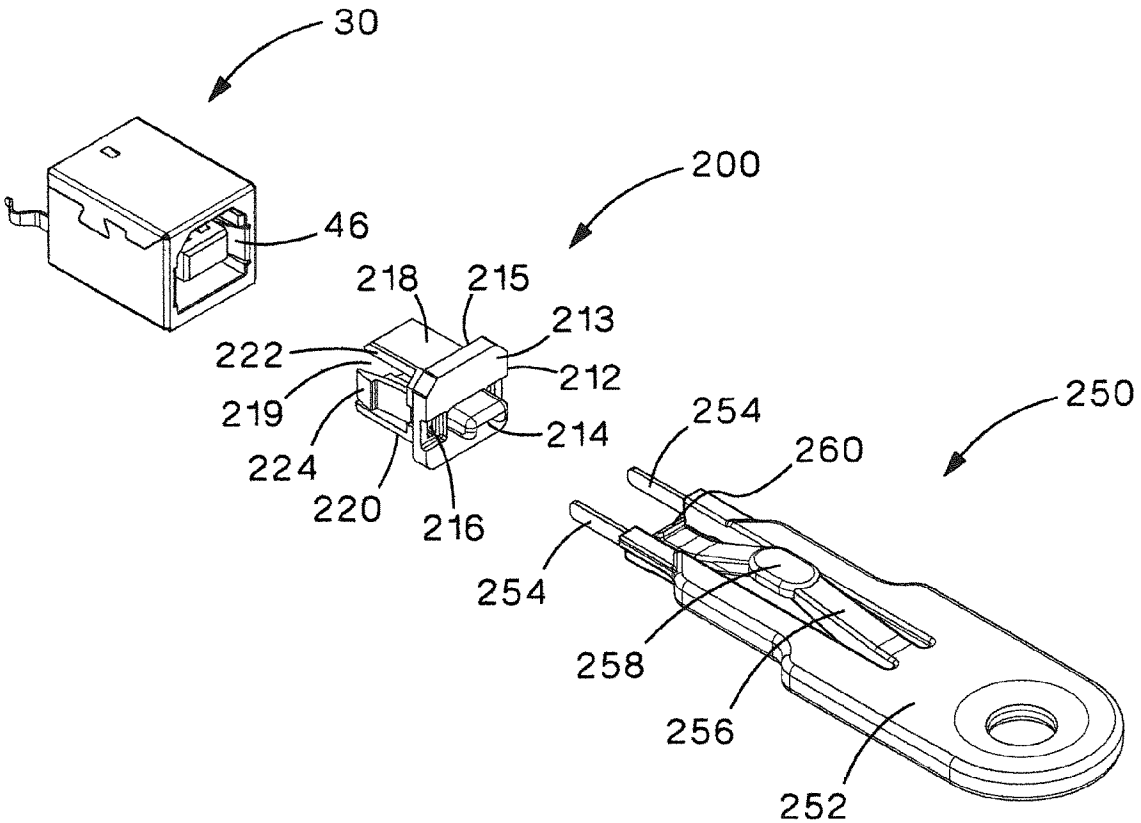
FIG. 11 illustrates an exploded view of an alternative blockout device of the present invention to be installed in the USB port.

As illustrated in FIGS. 9 and 10, to remove the blockout device 100 from the USB port 30, the removal tool 120 must be inserted into the blockout device 100. The metal tab 124 of the removal tool 120 is inserted into the front of the blockout device 100 and the upwardly facing hook 130 of the release lever 126 of the removal tool 120 engages the downwardly extending hook 114 extending from the shell 110. As illustrated in FIG. 9, the metal tab 124 deflects the molded latch 112 of the shell 110 downward out of the pocket 106 in the body 102 allowing the shell 110 and the body 102 to separate.

As a result, the molded teeth 104 of the body 102 are free to rise out of the contact slots 50 in the USB port 30. Once the shell 110 and body 102 are separated and the molded teeth 104 are removed from the contact slots 50, the removal tool 120 and connected blockout device 100 can be pulled from the USB port 30. The removal tool 120 is released from the blockout device 100 by depressing the raised knob 128 of the release lever 126 to disengage the upwardly facing hook 130 of the removal tool 120 from the downwardly facing hook 114 of the shell 110.

FIGS. 11-14 illustrate an alternative blockout device 200 for the USB "B" port 30. The alternative blockout device 200 is a removable blockout device that is removed from the USB port 30 via a removal tool 250. The removal tool 250 is similar to the removal tool disclosed in commonly owned U.S. Pat. Nos. 7,722,378; 7,862,365; 8,112,879; 8,113,856; and 8,202,110. The removal tool 250 includes a body 252 with a release lever 256. Metal tabs 254 extend from the front of the body 252. The release lever 256 includes a raised knob 258 at the center of the release lever 256 and an upwardly facing hook 260 at the free end.

Figure 12:
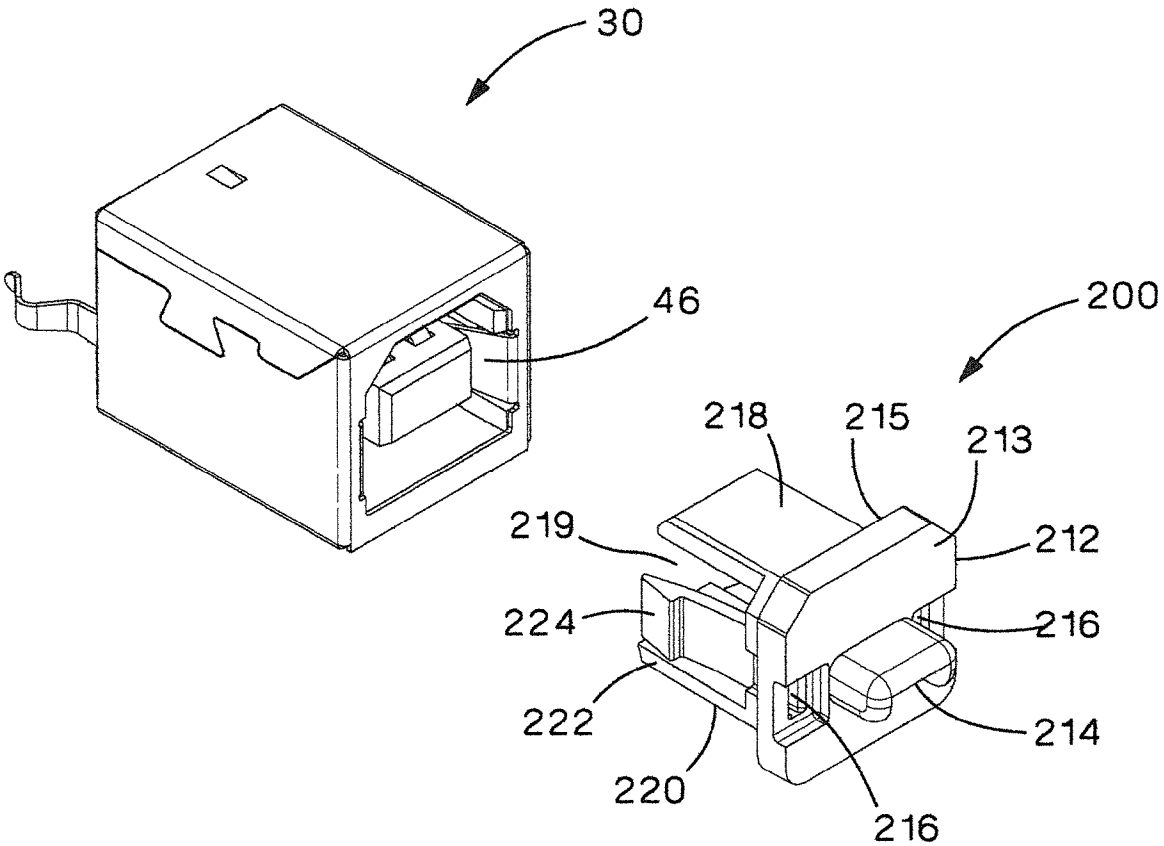
FIG. 12 illustrates the exploded view of the alternative blockout device of FIG. 11 to be installed in the USB port.

As illustrated in FIG. 12, the blockout device 200 includes a front 212 having a front surface 213 and a back surface 215. The blockout device 200 also includes a top 218, a bottom 220 and sides 222 extending from the back surface of the front 212. The bottom 220 extends parallel to the top 218 with an open area 219 therebetween. The front 212 of the blockout device 200 includes a downwardly facing hook 214 for engaging the removal tool 250 when the removal tool 250 is installed in the blockout device 200. The front 212 of the blockout device 200 also includes two windows 216 positioned adjacent to the downwardly facing hook 214 for receiving the metal tabs 254 of the removal tool 250. Alternatively, the blockout device 200 may be designed with out the windows in the front 212 thereby creating a permanent blackout device.

Figure 13:
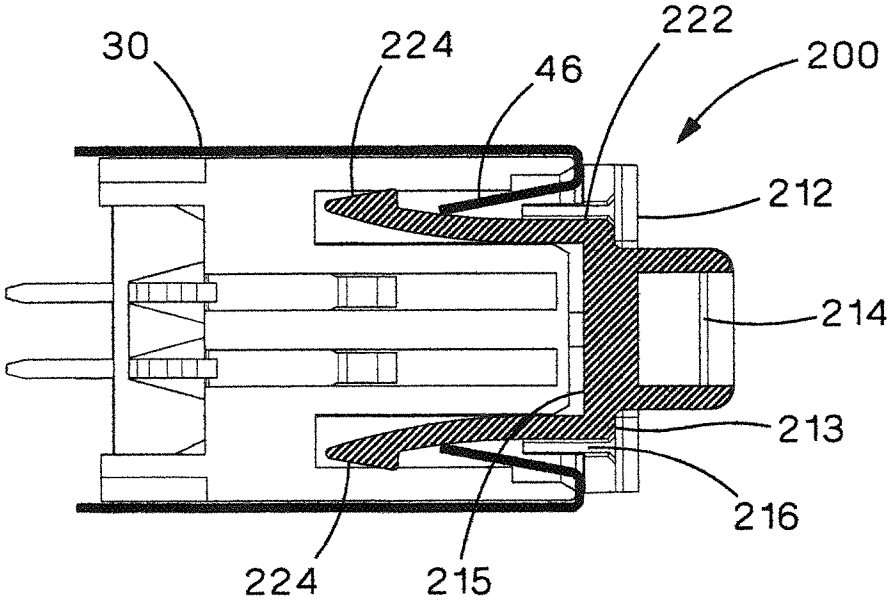
FIG. 13 illustrates a cross sectional view of the blockout device installed in the USB port of FIG. 11.

Each side 222 of the blockout device 200 includes a molded latch 224. When the blockout device 200 is installed in the USB port 30, the molded latches 224 deflect inward and snap back into their original position once the molded latches 224 are past the end of the clips or latches 46 in the USB port 30. The blockout device 200 is pushed into the USB port 30 until the blockout device 200 contacts the back wall of the USB port 30. As illustrated in FIG. 13, once installed, the molded latches 224 are positioned behind the clips 46 of the USB port 30 to secure the blockout device 200 in the USB port 30.

Figure 14:
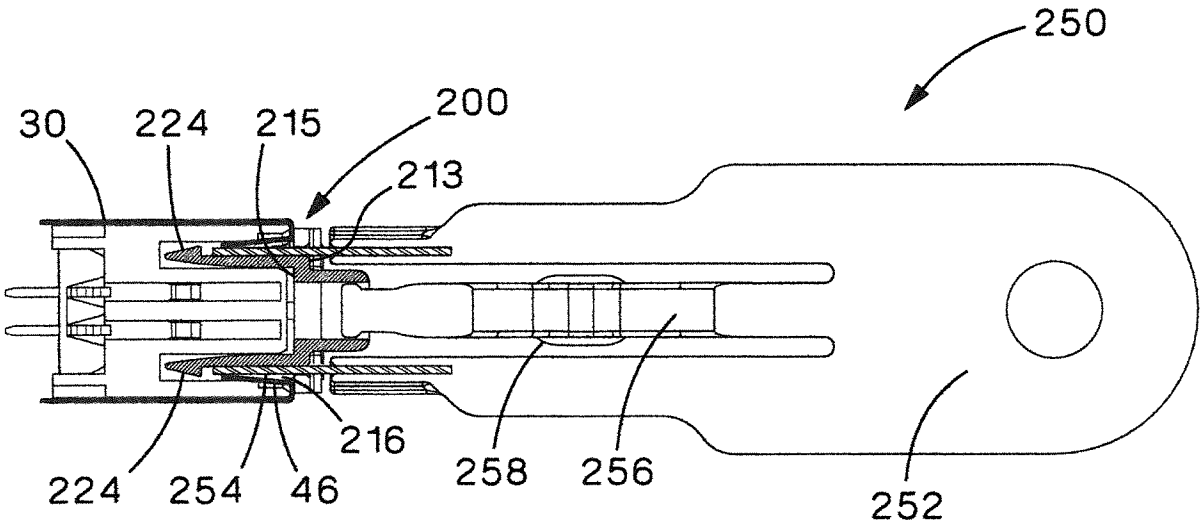
FIG. 14 illustrates a cross sectional view of the removal tool removing the blockout device of FIG. 13.

As illustrated in FIG. 14, to remove the blockout device 200 from the USB port 30, the metal tabs 254 of the removal tool 250 are inserted into the windows 216 in the front 212 of the blockout device 200. The hook 260 of the removal tool 250 engages the hook 214 of the blockout device 200. The metal tabs 254 deflect the molded latches 224 inward allowing the molded latches 224 to slide past the USB port clips 46 as the blockout device 200 is removed from the USB port 30. Finally, the removal tool 250 is released from the blockout device 200 by depressing the raised knob 258 of the release lever 256 to disengage the upwardly facing hook 260 of the removal tool 250 from the downwardly facing hook 214 of the blockout device 200.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation.

The invention claimed is:

1. A blockout device for a USB port having an inner channel and metal clips positioned within the channel, wherein the blockout device comprising:

a front for blocking the inner channel of the USB port, wherein the front having a front surface and a back surface;

a top extending a length from the back surface of the front;

a bottom extending from the back surface of the front parallel to the top, the bottom extending a length identical to the length of the top, wherein the top and the bottom define an open area therebetween; and sides extending from the back surface of the front and positioned in the open area between the top and the bottom, whereby the sides engage the metal clips positioned in the channel of the USB port to secure the blockout device to the USB port.

2. The blockout device of claim 1, wherein each side includes a latch that deflects inward as the blockout device is installed in the USB port.

3. The blockout device of claim 2, wherein the latches return to a pre-installed positioned once the latches have been inserted past the metal clips in the USB port.

4. The blockout device of claim 1, wherein the front having openings for receiving a removal tool.

5. The blockout device of claim 1, wherein the blockout device is removable.

6. A blockout device for a USB port having an inner channel and metal clips positioned within the channel, wherein the blockout device comprising:

a front member having a front surface and a back surface, wherein the front member having at least one opening extending from the front surface to the back surface for receiving a removal tool;

a top extending from the back surface of the front member;

a bottom extending from the back surface of the front member, wherein the bottom is parallel to the top with an open area therebetween; and sides extending from the back surface of the front member in the open area, wherein the sides deflect from a starting position inwards to an install position.

7. The blockout device of claim 6, wherein the back surface abuts against the USB port sealing the USB port.

8. The blockout device of claim 6, wherein the front member having a width and the top and bottom having a width, the width of the top and bottom is smaller than the width of the front member.

9. The blockout device of claim 6, wherein the sides deflect inwards between the top and bottom as the blockout device is installed in the USB port.

* * * * *